US005441112A

United States Patent [19]

de Melo Sanches et al.

[11] Patent Number: 5,441,112

[45] Date of Patent: Aug. 15, 1995

[54] INTEGRATED BASE FOR OIL DRILLING AND PRODUCTION WORK

[75] Inventors: Eduardo de Melo Sanches; Samir P. Awad; Cezar Augusto Silva Paulo; Orlando José Soares Ribeiro, all of Rio de Janeiro, Brazil

[73] Assignee: Petroleo Brasilerio S.A. - Petrobras, Rio de Janeiro, Brazil

[21] Appl. No.: 233,409

[22] Filed: Apr. 26, 1994

[30] Foreign Application Priority Data

Apr. 28, 1993 [BR] Brazil ..... 9301684

[51] Int. Cl.[6] ..... E21B 7/128

[52] U.S. Cl. ..... 166/358; 175/9

[58] Field of Search ..... 125/9, 5; 166/344, 358

[56] References Cited

U.S. PATENT DOCUMENTS 3,219,117 11/1965 Johnstone et al. ..... 166/358 X 5,316,089 5/1994 Fernandez ..... 166/358 X

*Primary Examiner*—William P. Neuder

*Attorney, Agent, or Firm*—Sughrue, Mion, Zinn, Macpeak & Seas

[57] ABSTRACT

An integrated oil drilling and producing base includes a single guiding funnel for guiding a wet Christmas tree into the proper position on a high pressure well head. The single guiding funnel has a cylindrical downcomer for resting directly on the high pressure well head, at least one cradle on the guiding funnel and at least one pipeline terminal hingedly mounted on said at least one cradle. The guiding funnel has a plurality of slits for allowing passage of a plurality of pipelines therethrough for connection to a respective terminal on the funnel and for connection of each terminal to the wet Christmas tree.

3 Claims, 5 Drawing Sheets

INTEGRATED BASE FOR OIL DRILLING AND PRODUCTION WORK

FIELD OF INVENTION

This invention is directed to an undersea structure intended to enable oil drilling, completing and producing equipment to be installed.

BACKGROUND OF INVENTION

This invention concerns an undersea structure known as an integrated drilling and producing base which will enable equipment intended for undersea oil drilling, completing and producing to be installed with fewer parts being employed than in the former method, the idea being to cut down on the amount of work, movements and cost of equipment needed.

STATE OF THE ART

The method generally employed for the drilling, completing and producing work in undersea oil wells used to call for two structures known as drilling and producing bases, which were intended to afford proper guidance for drilling tools and in the installing of the various kinds of completing and producing equipment needed for production purposes, as for instance, wet Xmas trees. A drilling base for deep water undersea wells is dealt with in Brazilian publication PI 8700104.

The drilling base is a sturdy, complex and a fundamental piece of equipment in good drilling work. After drilling a well another specially designed base had to De installed to enable parts involved specifically in production work to be put in (pipes, valves, connectors, control devices, etc.) and also a means had to De provided to transfer the oil drawn from the well. Special mention must be made of the undersea wells and particularly of those deep down. Those used to dealing with them well know how much time and money is spent in installing two different bases (along with all the shifting of heavy weights) and are aware of the sturdiness required of the first base in order to bear the weight of the second one and of other equipment.

In addition to the foregoing regard must be had for the fact that the connections that had to be made in the second stage of the assembly of the completion base led to the risk of leaks because there are more points that required sealing.

SUMMARY OF THE INVENTION

To do away with the need for two bases for drilling completing and producing work this invention uses one single base which deals with all these tasks and which is not only a considerable advance in technique but is also substantially cheaper and less laborious.

Another important feature to be taken into account concerning this invention is the precision of the connections that can be made, whereby sound coupling of the wet Xmas tree to the production string hanger and to the cradle used mainly for the oil outflow piping is achieved.

There are several fresh aspects to the equipment of this invention that enable the assembly of the parts needed to do the job and the installation thereof to be carried out with the aid of special tools, mainly by providing certain temporarily adaptable devices that make it easier to install and withdraw given parts in the connecting of oil outflow pipes and those for control fluids.

BRIEF DESCRIPTION OF DRAWINGS

The invention will now De described in greater details with the aid of the drawings attached hereto, viz.

DETAILED DESCRIPTION OF INVENTION

Figure 1:
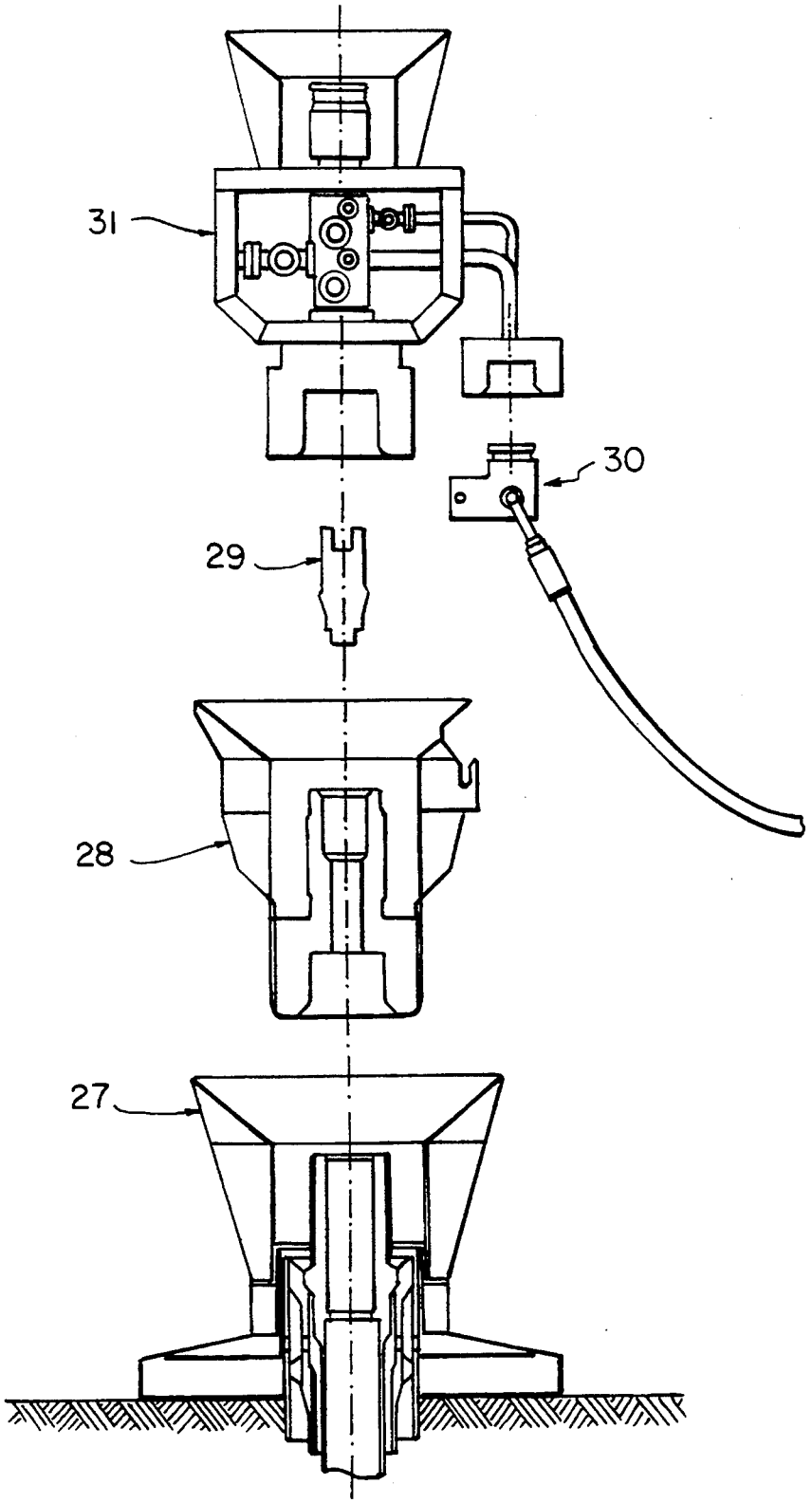
FIG. 1 PRIOR ART
FIG. 1 is a schematic view of the arrangement of a two base system, used in the prior state of the art.

FIG. 1 is a sketch of a typical two base system as used in the prior technique showing drilling base, 27, a completing and producing base, 28, tubing hanger, 29, undersea pipeline terminal, 30, and wet Xmas tree, 31.

It should be pointed out that where the expression "producing base" is used herein, it means equipment meant to properly guide the various kinds of equipment employed at completing and producing stages, the latter being nothing more than just an extension of the first.

The invention shown in FIGS. 2 to 5, though it must be assumed that other embodiments may result from use of the new technical ideas referred to herein.

Figure 2:
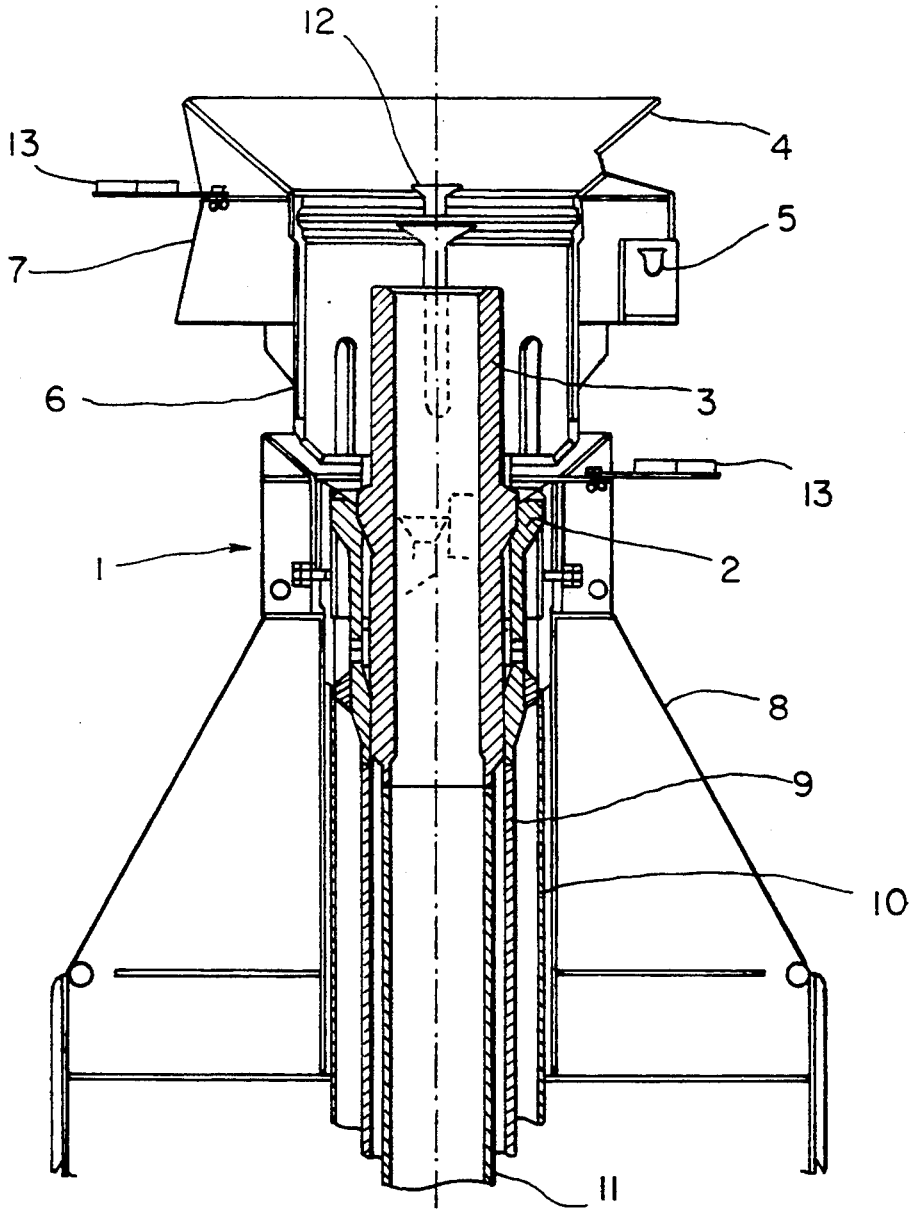
FIG. 2 is a side section view of the integrated drilling and completing base according to the present invention.

In FIG. 2 the integrated drilling and producing base, 1, mounted on its supporting structure, 8, can be seen standing on the top part of the outtermost casing, 10. Resting on said casing, 10, is the low pressure head, 2, which in turn supports the high pressure head, 3,and tubular conductor, 9. Said high pressure head, 3, supports casing, 11, and bears guiding funnel, 4, while cradle, 5, is fixed to said guiding funnel, 4. The casing pipes going down to variable depths in the bore hole, as required by the job, are referred to merely so that those that understand the art may imagine how the integrated base works, the gauges of the various pipes or how far they penetrate into the soil not being factors that limit this invention.

Figure 3:
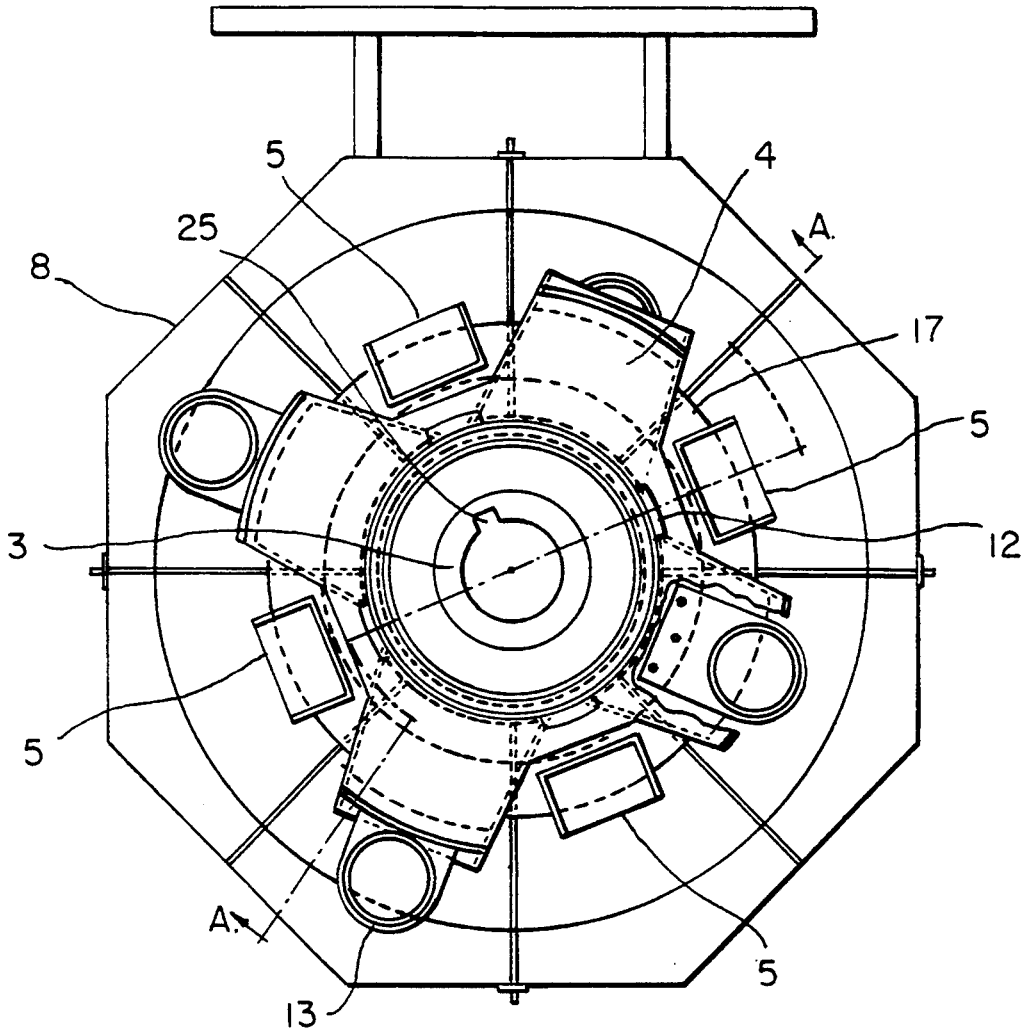
FIG. 3 is a top view of the integrated drilling and completing base.
Figure 4:
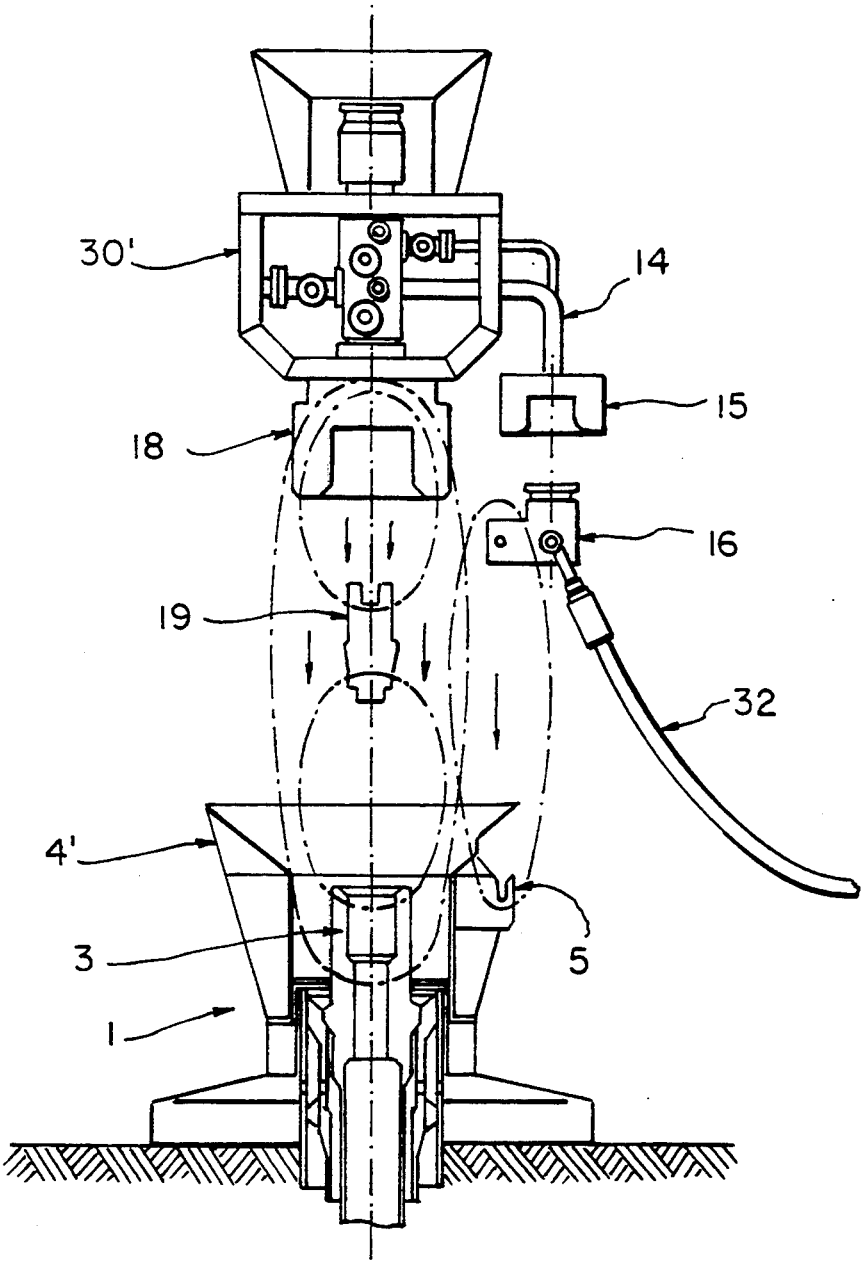
FIG. 4 is an exploded schematic view of the arrangement of this invention for assembly upon a well head showing necessary connections and oil carrying lines as well as other details of the arrangement.

FIGS. 2, 3 and 4 show other important features of the integrated drilling and producing base, namely:

a) supporting frame, 8, octagonal in shape in this embodiment, one with casing, 10, said supporting frame, 8, being nothing more than the temporary guiding base that rests on the bottom of the sea;

b) Y shaped slots, 12, intended for first rough guidance of wet Xmas tree into place when installing it, this being a typical feature of former art and which has been kept in this invention since it is highly important in guiding the coupling of the wet Xmas tree 26;

c) guiding funnel, 4, the only one to be used for the two operating modes of this base (drilling and producing);

d) cradle, 5, which is the adaptor to which the hinged terminal, 16, of oil carrying pipeline, 32, is fixed, leading to the oil receiving points, which hinged terminal receives at the same time connector, 15, of oil carrying pipeline, 14, from wet Xmas tree, 26;

e) cylindrical downcomer, 6, from funnel, 4, which fits on to the high pressure well head. 3, which in turn rests on low pressure well head, 2.

Other secondary operating features, as for instance, the stiffener, 7, are meant to strengthen funnel, 4, and ball levels, 13, which are shown only because they are visible in the view of the example itself but are nevertheless regarded as practically indispensable in all cases of assembly of such structures.

An essential feature of design is that the outside of the guiding funnel is not fully circular, it being cut into by slits (FIG. 3) big enough to allow oil carrying pipeline, 14, to pass through it relatively easily, coming from Xmas tree, 26, with connector, 15, adapted to a hinged terminal, 16, of oil flow pipeline, 32, so that the latter may easily fit into cradle, 5, when assembling wet Xmas tree, 26 (FIG. 4).

It should be noted that more than one cradle, 5, with its respective slit, 17, can be provided at integrated base, 1, as a way of making the job more flexible. In this embodiment choice was for four cradles, 5, with their respective slits, 17, all at right-angles to one another, but it should be understood that this number is a mere matter of choice out of the many possible alternatives, and must not therefore be regarded as a factor limiting the invention herewith applied for.

Position of keyway, 25, inside high pressure well head, 3, in relation to cradle, 5, chosen to bear hinged terminal, 16, is fundamental as regards simultaneous coupling of connector, 18 of wet Xmas tree, 26, to hanger, 19, and of hinged terminal, 16 to cradle, 5, which take place when wet Xmas tree, 26, is being installed, as will be seen later on. In order to enable this positioning of keyway, 25, of high pressure well head, 3, and cradle, 5, chosen to bear hinged terminal 16, to be done as accurately as possible, assembly and fitting devices used for such kinds of assembly work and which are not described herein since not within the scope of the invention and because they are widely known are employed.

Since position of production tubing hanger, 19, is what determines the final position of wet Xmas tree 26, and therefore direction of oil outflow pipeline, 32, hanger, 19, must be placed properly lined up with cradle, 5, chosen to bear hinged terminal, 16.

Thus, with integrated base, 1, and high pressure head, 3, installed in their proper positions, said tubing hanger, 19, is fixed inside high pressure head, 3 in such a way as to be able to take wet Xmas tree, 26. To enable tubing hanger, 19, to be installed in the right direction as regards cradle, 5, chosen to bear hinged terminal, 16.

Then, integrated base, 1, and high pressure head 3, having been installed in their proper places, said tubing hanger, 19, is fixed inside high pressure head, 3, in such a way as to take wet Xmas tree, 26. In order to enable tubing hanger, 19, to be installed in the right direction as regards cradle, 5, chosen to bear hinged terminal, 16, a bushing, 20, is provided to guide fitting of tubing hanger, 19, inside high pressure head, 3. Such guiding bushing, 20, is shown in FIG. 5 front view of invention.

Guiding bushing, 20, consists of a hollow cylindrical body, 21, cut off at its top end so that rim thereof opens out into the shape of a pair of half-spirals, 22, meant to direct tubing hanger, 19, when it is being put in, with the help of the installing tool, which latter is not shown in the drawing, and proper fit thereof within high pressure head, 3, is achieved when its key, 24, slides into keyway, 25, inside high pressure head, 3.

Figure 5:
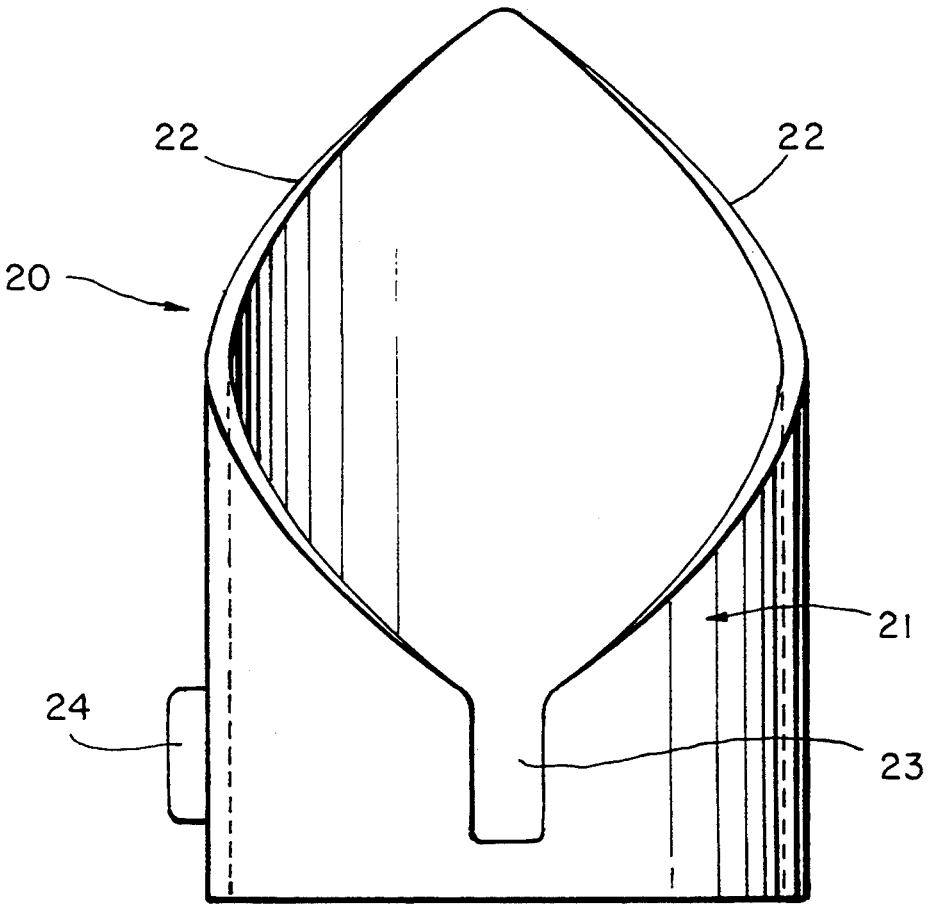
FIG. 5 is a front view of an adaptor bushing meant to guide a tubing hanger installing tool.

The tool used to put in hanger, 19, has a tip tongue which slides under its own weight and that of production string being installed, along spiral groove, 22 of said bushing, 20, to fit into slot, 23, shown in FIG. 5. Thus tubing hanger, 19, is brought into the proper position to ensure its being in line with cradle, 5, chosen to bear hinged terminal, 16, thereby ensuring that oil outflow pipeline, 32 is pointing in the right direction. After tubing hanger, 19, has been installed, bushing, 20, is withdrawn with the aid of its installing tool, from inside the blowout preventer which should be done after hanger installing tool has first of all been taken out.

A very important feature of this invention is that, contrary to the former technique, where guiding funnel is fitted to low pressure head, guiding funnel, 4, is installed directly fitted to high pressure head, 3, thereby doing away with any mechanical interfaces which would lead to play or wandering between cradle, 5, chosen to bear hinged terminal, 16, and keyway, 25.

FIG. 4 shows how wet Xmas tree, 26, will rest upon integrated base and how it will be connected to the other parts of integrated base, 1, or parts enveloped thereby in operation. The dotted lines and arrows show quite clearly how parts will fit smoothly into place thus ensuring an assembly that will operate soundly and reliably.

Hence line, 14, links wet Xmas tree, 13, sideways, to the connecting divice, 15, which fits into the hinged terminal, 16 for oil outflow pipe, 32. Hinged terminal, 16 is fitted to cradle, 5, when wet Xmas tree, 26, is installed. It is highly important that when the equipment is being manufactured that the distances between cradles, 5, and centerline of high pressure head are strictly equal, for cradles, 5, of adaptor base have a fixed position so that when equipment is being installed the distances previously referred to must be strictly obeyed if precision of connections is to be assured.

To sum up, the integrated drilling and producing base, 1, enables merely one kind of equipment to be used to guide drilling, completing and producing work, along with the advantage that it is easier to fit together the parts that have to be joined, and that fewer movements are called for, thereby cutting down on the number of mechanical interfaces between parts which would lead to play and wandering, while ensuring an extremely reliable and simpler and considerably cheaper assembly than under the former state of the art.

We claim:

1. An integrated oil drilling and producing base comprising a single guiding funnel for guiding a wet Christmas tree into position for connection to a high pressure well head, said single guiding funnel having a cylindrical downcomer for resting directly on the high pressure well head, at least one cradle on said guiding funnel and at least one pipeline terminal hingedly mounted on said at least one cradle, said guiding funnel having a plurality of slits for allowing passage of a plurality of pipelines therethrough for connection to a respective terminal and for connection of each terminal to the wet Christmas tree when mounted on said high pressure well head.

2. An integrated oil drilling and producing base as set forth in claim 1 further comprising a cylindrical tubing hanger for receiving and supporting a wet Christmas tree adapted to be mounted on an upper end of the high pressure well head and a hollow cylindrical guiding bushing having an upper rim in the shape of a pair of half spirals and having a key engageable in a key way in the high pressure well head to properly locate said half spirals relative to said at least one cradle, whereby said tubing hanger may be guided by said half spirals into a proper orientation relative to said at least one cradle.

3. An integrated oil drilling and producing base as set forth in claim 2 further comprising a plurality of cradles on said guiding funnel and a plurality of terminals hingedly mounted on said cradles for connecting the plurality of pipelines with a plurality of wet Christmas tree terminals.

* * * * *